US005540188A

United States Patent [19]

Heinrichs

[11] Patent Number: 5,540,188

[45] Date of Patent: Jul. 30, 1996

[54] TODDLER HARNESS

[76] Inventor: Stephen C. Heinrichs, c/o P.O. Box 132, Clayton, Ohio 45315

[21] Appl. No.: 490,650

[22] Filed: Jun. 15, 1995

[51] Int. Cl.[6] ..... A47D 13/08

[52] U.S. Cl. ..... 119/770; 119/907

[58] Field of Search ..... 119/770, 857, 119/907; 434/254, 255; 224/184, 158, 159, 160

[56] References Cited

U.S. PATENT DOCUMENTS

| | | | |
|---|---|---|---|
| 149,692 | 4/1874 | Tardy . | |
| 602,861 | 4/1898 | Lyon | 119/770 |
| 1,749,999 | 3/1930 | Crocker . | |
| 2,812,010 | 11/1957 | Abdallah . | |
| 2,871,915 | 2/1959 | Hogan . | |
| 2,956,541 | 1/1960 | Rall | 434/254 |
| 3,237,939 | 3/1966 | Olivet et al. . | |
| 3,721,437 | 3/1973 | Skaricic . | |
| 4,303,041 | 12/1981 | Thompson et al. . | |
| 4,545,575 | 10/1985 | Forjot . | |
| 4,666,017 | 5/1987 | Zimmerman . | |
| 4,922,860 | 5/1990 | Hutchings . | |
| 5,010,850 | 4/1991 | Sailer | 224/184 |
| 5,120,287 | 6/1992 | Brown et al. . | |
| 5,226,820 | 7/1993 | Pearson . | |
| 5,242,238 | 9/1993 | Steinbrueck . | |
| 5,351,654 | 10/1994 | Fuentes | 119/770 |

FOREIGN PATENT DOCUMENTS

| | | | |
|---|---|---|---|
| 2674114 | 9/1992 | France | 224/159 |

*Primary Examiner*—Robert P. Swiatek
*Assistant Examiner*—Elizabeth Shaw
*Attorney, Agent, or Firm*—Biebel & French

[57] ABSTRACT

A safety harness is provided having a first loop, a second loop and a grasping portion. The first loop includes a first end and a second end and a first padded portion while the second loop also has a first end, a second end and a second padded portion. The grasping portion is adjacent the first end and the second end of both the first loop and the second loop. A method for enabling a first person to aid in a second person's balance and mobility using this device is also disclosed.

16 Claims, 4 Drawing Sheets

TODDLER HARNESS

FIELD OF THE INVENTION

The present invention relates generally to a safety harness, and more particularly to one which can assist in stabilizing the balance of its user.

BACKGROUND OF THE INVENTION

Safety harnesses or harnesses which can be used to restrain the movement of the wearer of such harness are not new in and of themselves. One of the earliest devices that was patented was the baby exercising corset patented by Tardy and disclosed in U.S. Pat. No. 149,692. This particular device was for use in assisting the baby in walking and consisted of a corset secured about the torso of an infant with two cords E attached to the upper edge of the corset. Each of the cords E may be grasped by an adult so as to support the child in an erect position.

This manually held type of supportive device is also disclosed in Crocker, U.S. Pat. No. 1,749,999 where the hand-held straps 6 are secured to the upper rear portion of the body band adapted to be secured about the torso of a child.

More recently, Zimmerman, U.S. Pat. No. 4,666,017, discloses an infant harness having a waistband, a back piece, a pair of shoulder straps, and a tether. This tether is secured to the back piece of the harness, at approximately waist-level. It can be appreciated from this particular invention that the purpose is not meant to be the vertical support of the child as was the case in Tardy or Crocker, but more of a horizontal restraint to prevent the child from running away from the individual holding the single-strap tether.

Safety harnesses also have involved devices which in addition to being secured the torso of an individual are secured in part through the legs. Examples of such harnesses are Hogan, U.S. Pat. No, 2,871,915and Hutchings, U.S. Pat. No. 4,922,860 of these devices disclose somewhat more elaborate harnesses which in the case of Hogan are then utilized with relatively heavy mechanical supporting devices to assist in supporting the wearer.

Some of the harnesses also utilize hand grips for the wearer, with examples of these being the baby walking aid of Olivett et al, U.S. Pat. No. 3,237,939 and Brown et al, U.S. Pat. No. 5,120,287. Both of these devices disclose harnesses having a plurality of parts and which are designed to have the wearer hold a hand grip fabricated as part of the harness itself. Safety harnesses also have included the construction shown in Steinbrueck, U.S. Pat. No. 5,242,380. While similar to that of Crocker, it should be appreciated that this particular harness is used with some type of elevated support means such as a ceiling.

While safety harnesses of the types described above have often been used to assist an individual in walking, or in the elimination of discomfort in the back region, and in the actual restraint of motion as disclosed in Zimmerman, some safety harnesses have been devised for use in training a child in the riding of a bicycle. An example of this type of safety harness is the patent to Pearson, U.S. Pat. No. 5,226,820. This particular device shows a handle connected to a single loop, which loop is selectively adjusted about the child's waist to provide a means to assist in the support and control the balance the child as he learns to ride a bicycle.

One thing which most of the prior art restraints have in common is a relatively complex and costly structure which makes the use of such devices relatively cumbersome, or at the very least mildly burdensome for both the wearer and any individual who assists in the stabilization of the user of the device. Additionally, many of the devices, although purportedly useful in assisting with the maintenance of the balance of the wearer, can be appreciated as being slightly deficient in that regard.

Therefore, it would be desirable to have a safety harness which is of both a simple construction and easy to use.

SUMMARY OF THE INVENTION

In accordance with the present invention, a safety harness is provided with this safety harness having a first loop, a second loop, and a grasping portion, with the first loop comprising a first end and a second end, and a first padded portion, and the second looping comprising a first end, a second end, and a second padded portion. This safety harness first loop comprises a first surface and a second surface, with the first surface having an exterior surface and an interior surface. Similarly the second surface has an exterior surface and an interior surface. The first surface interior surface is opposed to the second surface interior surface. The first padded portion comprises padding, with this padding being disposed between the first surface interior surface of the first loop and the second surface interior surface of the first loop. Furthermore, the second loop also comprises a first surface and a second surface with the first surface having an exterior surface and an interior surface and the second surface having an exterior surface and an interior surface. As was the case with the first loop, the first surface interior surface of the second loop is also opposed to the second surface interior surface, the second padded portion comprises padding, and the padding is disposed between the first surface interior surface of the second loop and the second surface interior surface of the second loop.

Preferably the first loop is of a first length and the first padded portion is of a shorter length. Similarly, the second loop is of a second length and the second padded portion is of a shorter length. Preferably the first and second lengths are equal. With respect to the grasping portion, it preferably is directly adjacent the first end and the second end of the first loop, and directly adjacent the first end and second end of the second loop. Preferably the first and second padded portions of foamed rubber although they maybe formed of cloth batting.

There is also disclosed a safety harness comprising a first loop, a second loop, and a grasping portion with the first loop comprising a first end and a second end and a first padded portion, the second loop comprising a first end, a second end, and a second padded portion, and the grasping portion being co-extensive with a section of the first loop and second loop.

This safety harness first loop comprises a first surface and a second surface, with the first surface having an exterior surface and an interior surface. Similarly the second surface has an exterior surface and an interior surface. The first surface interior surface is opposed to the second surface interior surface. The first padded portion comprises padding, with this padding being disposed between the first surface interior surface of the first loop and the second surface interior surface of the first loop. Furthermore, the second loop also comprises a first surface and a second surface with the first surface having an exterior surface and an interior surface and the second surface having an exterior surface and an interior surface. As was the case with the first loop, the first surface interior surface of the second loop is also opposed to the second surface interior surface, the second padded portion comprises padding, and the padding is disposed between the first surface interior surface of the second loop and the second surface interior surface of the second loop.

Preferably the first loop is of a first length and the first padded portion is of a shorter length. Similarly, the second loop is of a second length and the second padded portion is of a shorter length. Preferably the first and second lengths are equal. With respect to the grasping portion, it preferably is directly adjacent the first end and the second end of the first loop, and directly adjacent the first end and second end of the second loop. Preferably the first and second padded portions of foamed rubber although they maybe formed of cloth batting.

There is also disclosed a method for enabling a first person to aid in a second person's mobility using a device having a first loop, a second loop and a grasping portion with the first loop having a first end and a second end and a first padded portion and with the second loop having a first end and a second end and a second padded portion with the method comprising engaging the first loop about the body of the person to be aided such that the first padded portion is against the person's back and the remainder of the first loop extends under the person's arms. The second loop is engaged about the person's body by passing their arms through the second loop and adjusting the second loop about the person's body, such that the second padded portion is against the person's chest and the remainder of the second loop extends under the person's arms. This method also comprises having the first person raise the grasping portion above the head of the person to be aided so as to aid in their mobility. This method also allows for the first person to remain in a comfortable, vertical position while aiding the second person. In the preferred embodiment of the invention, the grasping portion is co-extensive with a section of the first loop and the second loop.

The primary objective of this invention is to provide a safety harness that is of extremely economical construction and is particularly easy to use.

A further objective of this invention is to provide a safety harness which is effective in stabilizing and controlling an individual who may have problems with balance.

These and other objects and advantages of this invention will be readily apparent from the following detailed description of an illustrative embodiment thereof. Reference will be had to the accompanying drawings which illustrate the embodiment of the invention.

DESCRIPTION OF THE ILLUSTRATIVE INVENTION

Figure 1:
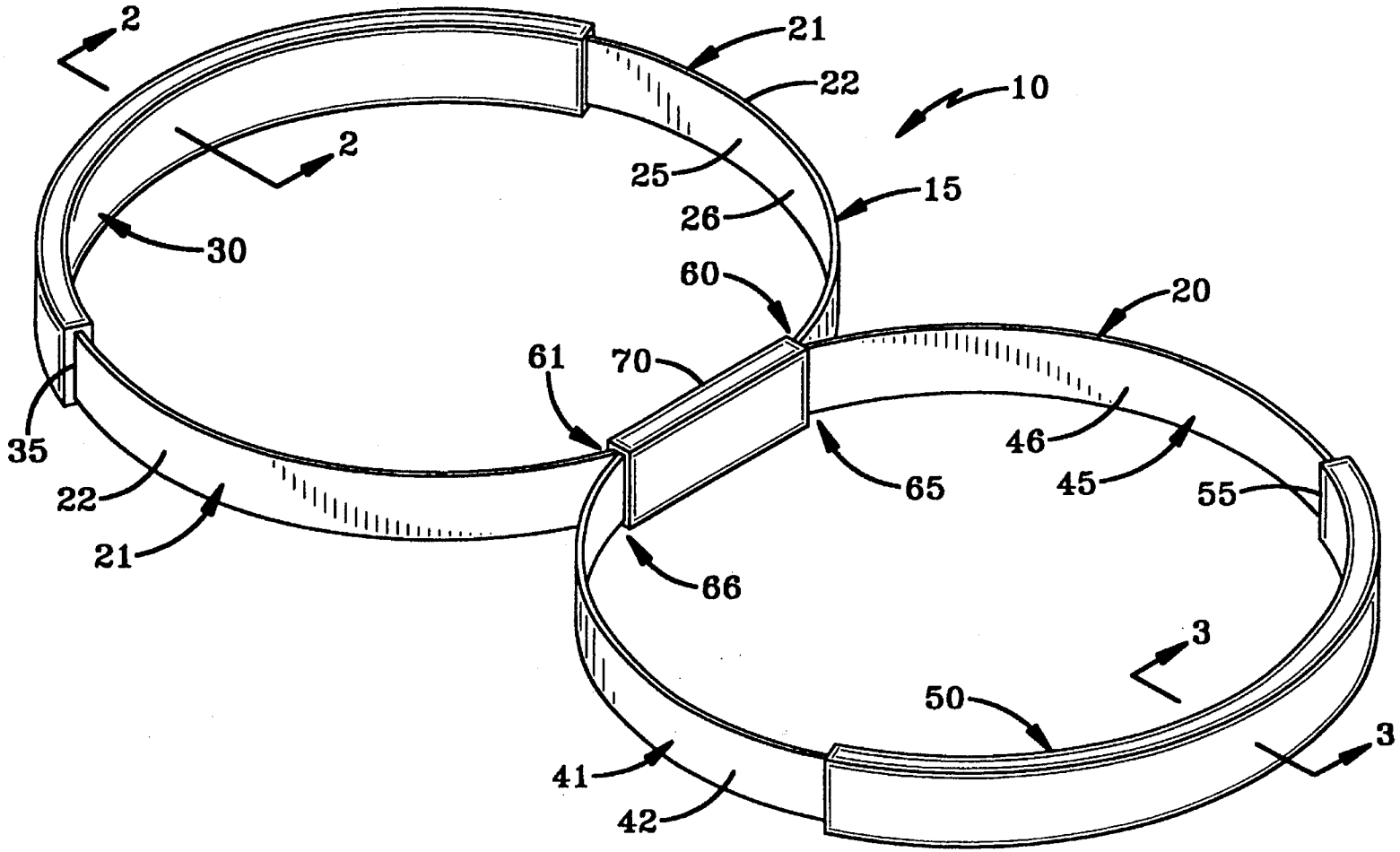
FIG. 1 is a perspective view disclosing the invention.

Having reference to the drawing figures, attention is directed first to FIG. 1 which illustrates a safety harness embodying this invention with this safety harness being designated generally by the numeral 10. This safety harness 10 can be appreciated as comprising a first loop 15 and second loop 20. However, it should also be appreciated that although the device is shown having two looped members, the actual fabrication of this harness preferably involves a nylon fabric material, which for the most part does not have a definitive geometric structure. Instead, the structural component of the safety harness realistically comprises two straps essentially joined to one another. However, for purposes of discussion the invention has been drawn such that the strap portions are set forth in a generally circular layout.

Figure 2:
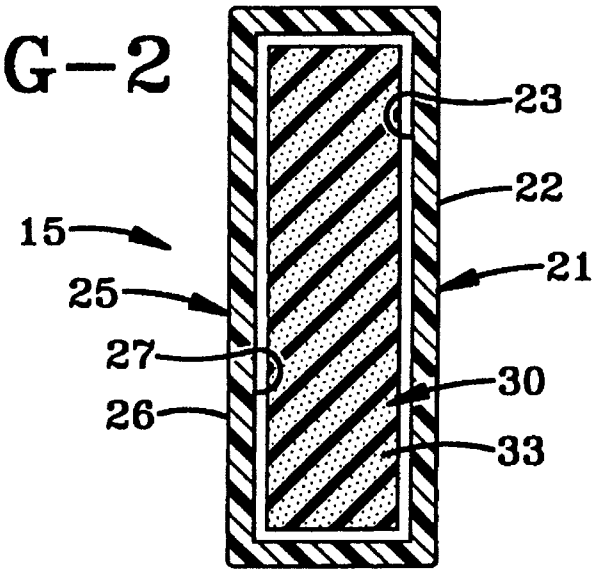
FIG. 2 is a vertical sectional view on a greatly enlarged scale taken along line 2—2 of FIG. 1.

The first loop or first strap 15, as can be appreciated from FIGS. 1 and 2, has a first surface 21 with this first surface 21 having a first surface exterior 22 and a first surface interior 23. Since this first loop 15 preferably is comprised of a piece of folded over nylon fabric, the first loop also has a second surface 25 having a second surface exterior 26 and a second surface interior 27. Thus it can be appreciated that the padding 33 is disposed within the harness, as opposed to on the harness' exterior.

It will also be appreciated that there is a first padded portion 30 with this first padded portion 30 comprising a portion of the first loop with padding 33 disposed between the first interior 23 of the first surface 21 and the second surface interior 27 of the second surface 25. To assist in padding 33 remaining in a confined space, there are padding retaining means 35, preferably in the form of stitches which preclude the padding from excessive lateral movement within the first loop 15.

Figure 3:
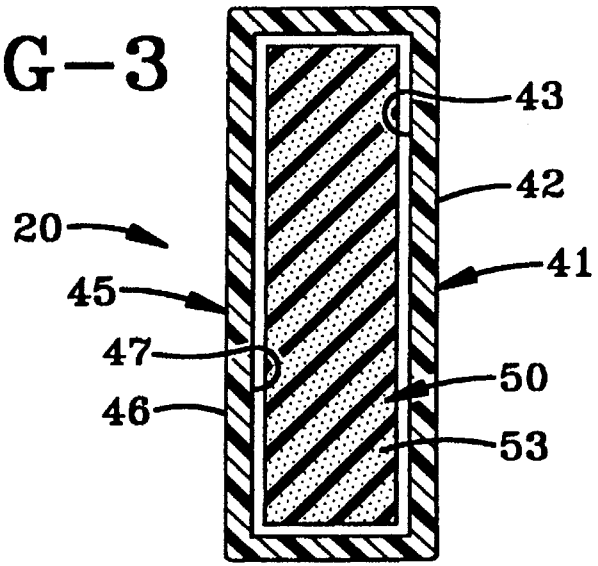
FIG. 3 is a vertical sectional view on a greatly enlarged scale taken along line 3—3 of FIG. 1.

Similarly, with respect to second loop 20, as can be seen in FIGS. 1 and 3, the second loop is comprised of a first surface 41 having a first surface exterior 42 and a first surface interior 43. Additionally, the second loop or second strap portion has a second surface 45 having a second surface exterior 46 and a second surface interior 47.

Once again the second padded portion 50 is comprised of padding 53 with there being padding retaining means 55 similar to padding retainer means 35. Thus it can be appreciated that the padding 53 is disposed within the harness, as opposed to on the harness' exterior. With respect to the composition of this padding, preferably it is of rubber or some type of closed cell foam, such as a polystyrene closed cell foam pad, although in some applications, it may be preferable to substitute a cloth batting for the more durable rubber pad.

The first loop has a first end 60 and a second end 61 while the second loop 20 has a second loop first end 65 and a second loop second end 66 as can best be appreciated from FIG. 1.

The grasping portion is shown as being directly adjacent the first end and second end of both the first loop and the first end and second end of the second loop. In the preferred embodiment of the invention this grasping portion is co-extensive with a second of both the first loop and the second loop.

It will be appreciated that the first loop is of a first length and the first padded portion is of a shorter length. Similarly, the second loop is of a second length and the second padded portion is of a shorter length. In the preferred embodiment of the invention the first length of the first loop and the second length of the second loop are equal. It should be appreciated that the strap size and width will vary depending upon whether this particular device is used with infants, toddlers, or adults. With infants or toddlers, the cloth batting may be the preferable choice for padding, while in older toddlers who use the device in learning to ride a bicycle or skate or in older children or adults the foamed rubber pad choice for padding is preferable. In an embodiment of the invention comprising the rubber pad and which embodiment is useful in assisting a toddler or other young child in learning to ride a bicycle, the dimensions are as follows: the length of the entire first loop is 68", the length of the second loop is 68", the length of both the first and second padded portions are 24" with the height of the padded portion being 2" and its thickness being ¼" The actual length of the grasping portion or handle is 4" It should also be appreciated that this grasping portion may preferably have a portion of fabric which encases the actual juncture associated with both the first strap and second strap, thereby minimizing any potential for discomfort to the hand of the individual assisting the user of the invention.

Figure 6:
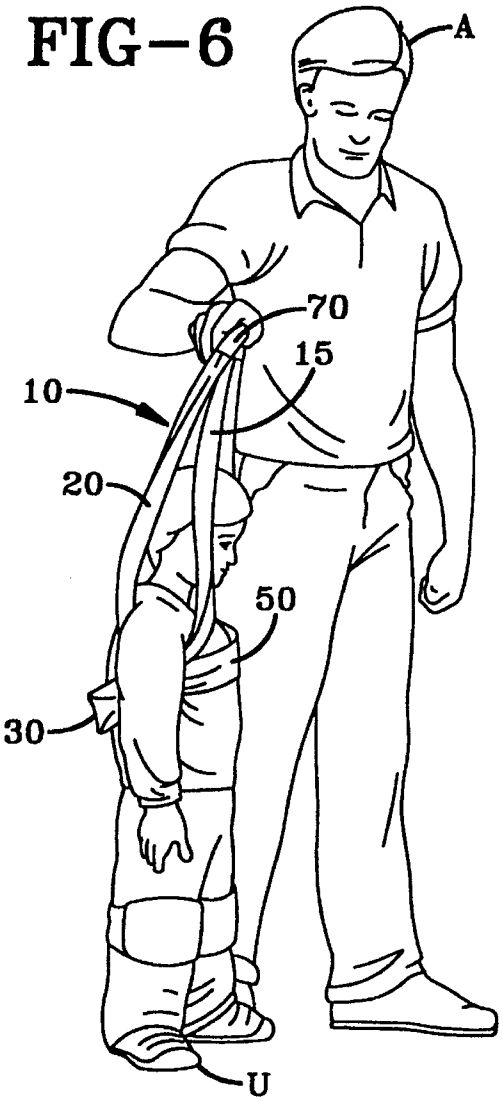
FIG. 6 discloses the invention in its operable position.
Figure 5:
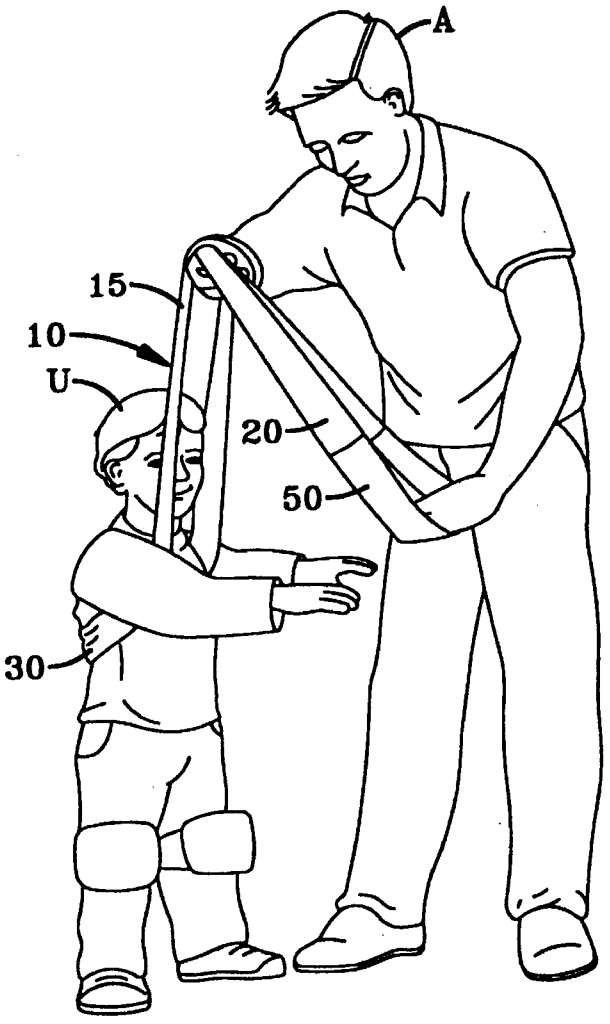
FIG. 5 discloses an intermediate step in the method of use of the invention.
Figure 4:
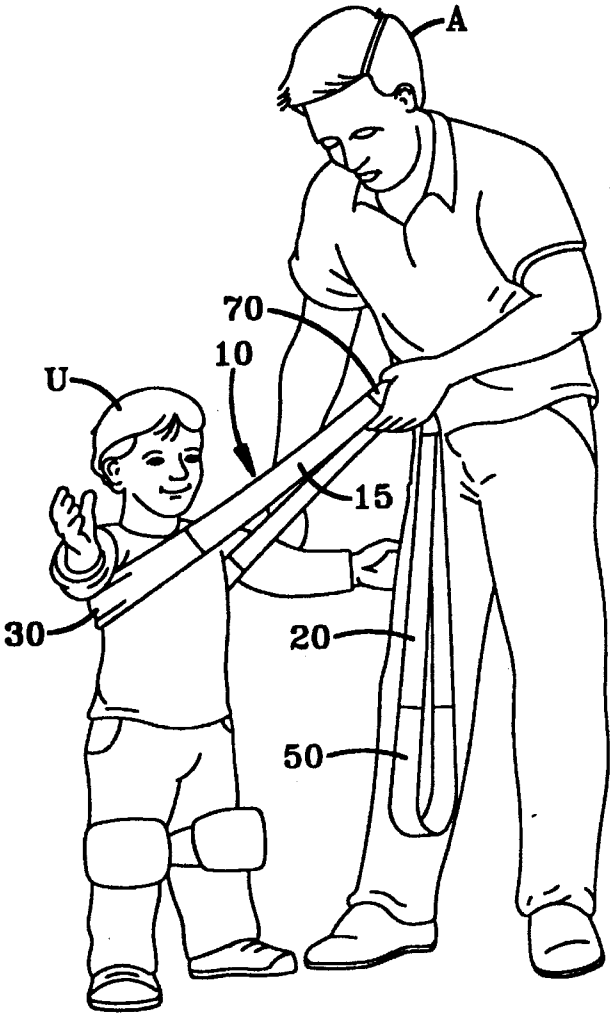
FIG. 4 discloses the initial step in the method of using the invention.

It has somewhat unexpectedly been discovered that there are a number of potential uses for the safety harness of this invention. Regardless of the ultimate potential use, the method for enabling a first person to aid in a second person's balance and mobility using this device is the same. This particular method can best be appreciated from a comparison of FIGS. 4. 5, and 6. These figures depict a user U, and an assistant A. It should be understood that the user U could be an infant, a toddler, a child, or even an adult, but that for purposes of these drawings all are shown with a relatively young child as the user. The method for enabling the first person to aid in the second person's balance and mobility begins with engaging the first loop about the body of the person to be aided as shown in FIG. 4. It will be appreciated that the first padded portion 30 is located adjacent the person's back. The remainder of the first loop extends under the user's arms. As shown in FIG. 5, the second loop is engaged about the user's body by passing their arms through the second loop 20 and then adjusting the second loop about the body such that the second padded portion 50 rests against the person's chest and the remainder of the second loop extends under the person's arms. As shown in FIG. 6, the first person or the assistant A then raises the grasping portion 70 above the head of the user such that the first person may then aid in the second person's mobility.

Figure 8:
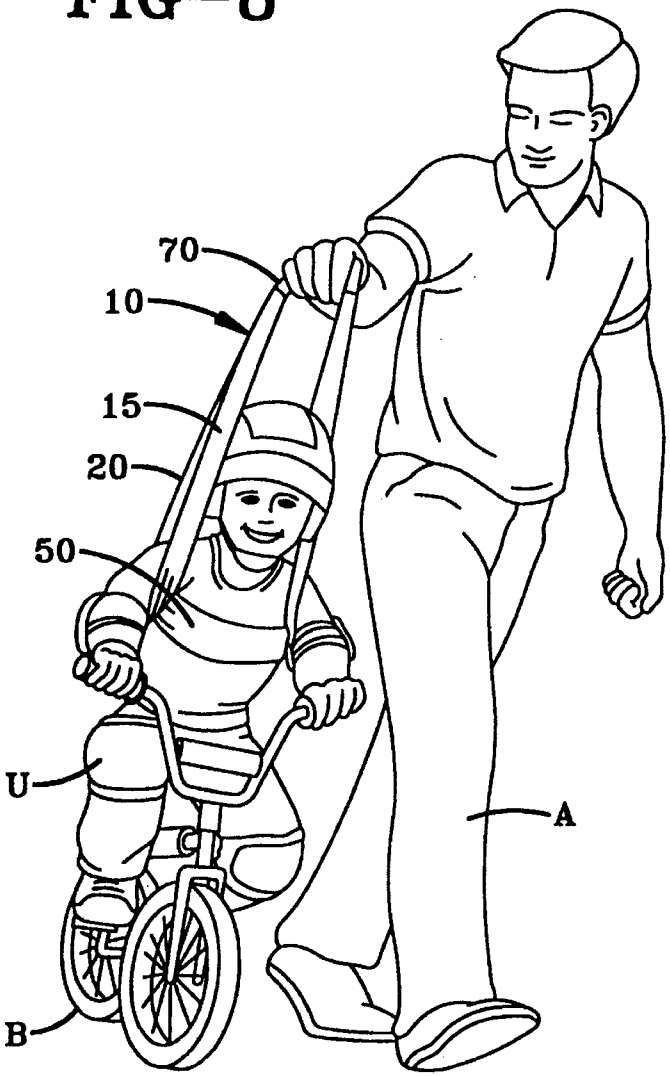
FIG. 8 discloses another view of the use of this invention.
Figure 7:
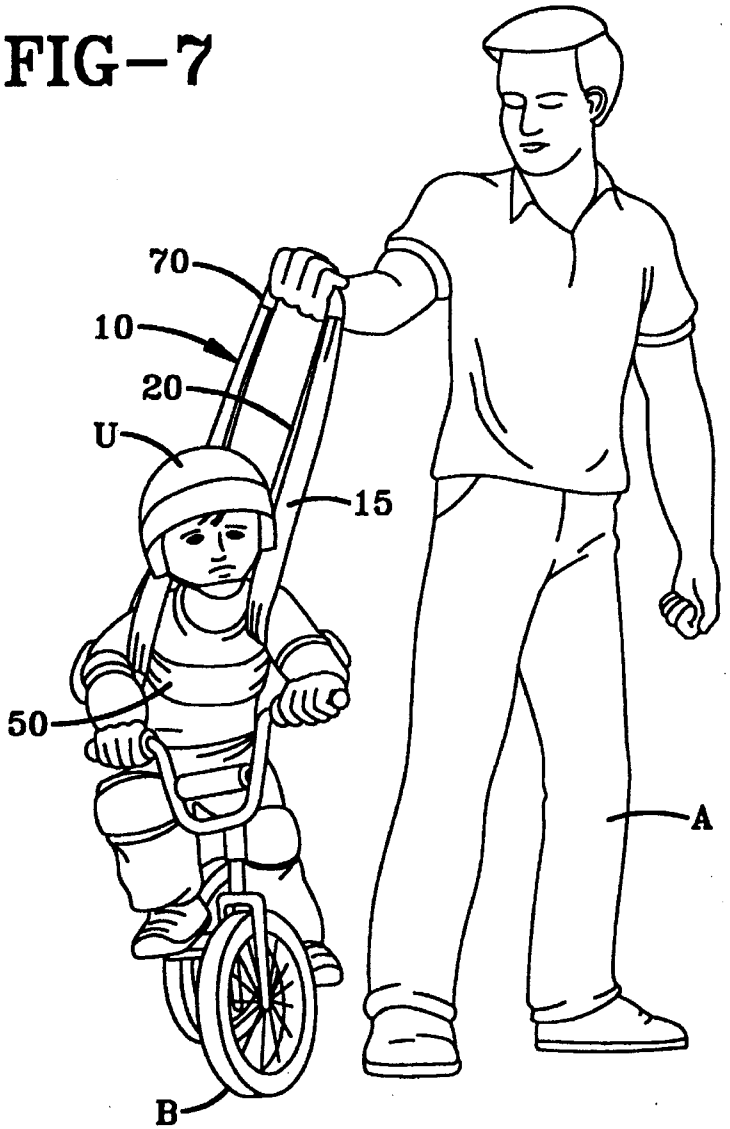
FIG. 7 discloses one example showing the use of the invention.

It has unexpectedly been discovered that the particular method of this invention has many uses. For example, this particular invention can be used in assisting infants or young toddlers in learning to walk. With the assistant A easily being able to suspend the child from the handle 70. Due to the simplicity associated with this invention, it is far easier to use with a wiggling child then the multi-component prior art devices. Another example is the use of this particular invention assisting a child in learning to ride a bicycle B as shown in FIGS. 7 and 8. Once the safety harness 10 is secured about user U the assistant A can stabilize a child when he looses balance as shown in FIG. 7 and correct the balance so that the child can continue having a pleasurable riding experience as shown in FIG. 8.

Yet another use for this invention is assisting individuals who are blind in learning to walk. One of the fears of those who are blind is that they will bump into an object while walking. Therefore, it is important that they have their hands free. Unfortunately, prior art learning devices which have necessitated their holding onto a handle restrict the free movement of their hands. Meanwhile, this particular device permits an individual who is blind to utilize the invention and have their mobility stabilized while at the same time not encumbering the uses to which their hands may be put.

Still another potential use for the device is with children and even adults who have Downs Syndrome. These individuals often have problems with their balances, mobility and ability to jump. However, relatively confining devices as were common in the prior art were extremely difficult to use with these individuals. Additionally, as in many prior art safety harnesses, there was insufficient ability to actually assist in the stabilization of the individuals while walking, rather the devices were more along the lines of harnesses meant to restrain the horizontal mobility of the user.

Additional uses for the device include teaching individuals to skate, roller skate, or inline skate by assisting in their balance. This device aids in maintaining the balance of the learner, thereby decreasing the learning time.

It will be readily apparent, from the foregoing detailed description of an illustrative embodiment of this invention that a particularly novel and extremely effective safety harness is provided. This safety harness is relatively simple to fabricate and requires a minimal amount of time for engagement about the body of the user. Additionally, the device is economical.

What is claimed is:

1. A safety harness comprising a first loop, said first loop comprising a first end and a second end, a first surface and a second surface, and a first padded portion, said first surface having an exterior surface and an interior surface, said second surface having an exterior surface and an interior surface, said first surface interior surface being opposed to said second surface interior surface, said first padded portion comprising padding, said padding being disposed between said first surface interior surface of said first loop and said second surface interior surface of said first loop, a second loop, said second loop comprising a first end and a second end and a second padded portion, and a grasping portion.

2. The safety harness according to claim 1 wherein said second loop comprises a first surface and a second surface, said first surface having an exterior surface and an interior surface, said second surface having an exterior surface and an interior surface, said first surface interior surface being opposed to said second surface interior surface, said second padded portion comprising padding, said padding being disposed between said first surface interior surface of said second loop and said second surface interior surface of said second loop.

3. The safety harness according to claim 1 wherein said first loop is of a first length and said first padded portion is of a shorter length.

4. The safety harness according to claim 3 wherein said second loop is of a second length and said second padded portion is of a shorter length.

5. The safety harness according to claim 1 wherein said first loop is of a first length and said second loop is of a second length, said first and second lengths being equal.

6. The safety harness according to claim 1 wherein said grasping portion is directly adjacent said first end and second end of said first loop, and said grasping portion is directly adjacent said first end and second end of said second loop.

7. The safety harness according to claim 1 wherein said first and second padded portions are foamed rubber.

8. The safety harness according to claim 1 wherein said first and second padded portions are formed of cloth batting.

9. A safety harness comprising a first loop, said first loop comprising a first end and a second end, a first surface and a second surface, and a first padded portion, said first surface having an exterior surface and an interior surface, said second surface having an exterior surface and an interior surface, said first surface interior surface being opposed to said second surface interior surface, said first padded portion comprising padding, said padding being disposed between said first surface interior surface of said first loop and said second surface interior surface of said first loop, a second loop, said second loop comprising a first end and a second end and a second padded portion, and a grasping portion, said grasping portion being coextensive with a section of said first loop and said second loop.

10. The safety harness according to claim 9 wherein said second loop comprises a first surface and a second surface, said first surface having an exterior surface and an interior surface, said second surface having an exterior surface and an interior surface, said first surface interior surface being opposed to said second surface interior surface, said second padded portion comprising padding, said padding being disposed between said first surface interior surface of said second loop and said second surface interior surface of said second loop.

11. The safety harness according to claim 9 wherein said first loop is of a first length and said first padded portion is of a shorter length.

12. The safety harness according to claim 11 wherein said second loop is of a second length and said second padded portion is of a shorter length.

13. The safety harness according to claim 9 wherein said first loop is of a first length and said second loop is of a second length, said first and second lengths being equal.

14. The safety harness according to claim 9 wherein said grasping portion is directly adjacent said first end and second end of said first loop, and said grasping portion is directly adjacent said first end and second end of said second loop.

15. A method for enabling a first person to aid in a second person's mobility using a device having a first loop, a second loop, and a grasping portion, with the first loop comprising a first end and a second end and a first padded portion, and with the second loop comprising a first end and a second end and a second padded portion, the method comprising engaging the first loop about the body of the person to be aided, such that the first padded portion is against the person's back and the remainder of the first loop extends under the person's arms, and engaging the second loop about the person's body by passing their arms through the second loop and adjusting the second loop about the person's body, such that the second padded portion is against the person's chest and the remainder of the second loop extends under the person's arms, and having the first person raise the grasping portion above the head of the person to be aided so as to aid in their balance and mobility.

16. The invention as set forth in claim 15 wherein the grasping portion is coextensive with a section of the first loop and the second loop.

* * * * *